US012545458B2

(12) United States Patent
Salvato et al.

(10) Patent No.: US 12,545,458 B2
(45) Date of Patent: Feb. 10, 2026

(54) METHOD FOR PACKAGING PRODUCTS IN BOXES AND PACKAGING APPARATUS OPERATING ACCORDING TO THIS METHOD

(71) Applicant: R.A Jones & Co., Covington, KY (US)

(72) Inventors: Anthony B. Salvato, Cincinnati, OH (US); R. Todd Gatman, Burlington, KY (US); Andrea Biondi, Bologna (IT); Luca Cavazza, Bologna (IT); Enrico Campagnoli, Bologna (IT)

(73) Assignee: R.A Jones & Co., Covington, KY (US)

( * ) Notice: Subject to any disclaimer, the term of this patent is extended or adjusted under 35 U.S.C. 154(b) by 46 days.

(21) Appl. No.: 18/245,188

(22) PCT Filed: Oct. 26, 2021

(86) PCT No.: PCT/IB2021/000741
§ 371 (c)(1),
(2) Date: Mar. 14, 2023

(87) PCT Pub. No.: WO2022/090798
PCT Pub. Date: May 5, 2022

(65) Prior Publication Data

US 2024/0017866 A1 Jan. 18, 2024

Related U.S. Application Data

(60) Provisional application No. 63/105,417, filed on Oct. 26, 2020, provisional application No. 63/105,426, filed on Oct. 26, 2020.

(30) Foreign Application Priority Data

Oct. 30, 2020 (IT) ..... 102020000025912
Oct. 30, 2020 (IT) ..... 102020000025924

(51) Int. Cl.
*B65B 43/00* (2006.01)
*B65B 5/06* (2006.01)
(Continued)

(52) U.S. Cl.
CPC ..... *B65B 43/265* (2013.01); *B65B 5/06* (2013.01); *B65B 43/54* (2013.01); *B65B 57/04* (2013.01)

(58) Field of Classification Search
CPC ..... B65B 5/06; B65B 43/54; B65B 43/265; B65B 57/04; B31B 50/80; B31B 50/006
See application file for complete search history.

(56) References Cited

U.S. PATENT DOCUMENTS 4,854,111 A * 8/1989 Roberts ..... B65B 63/02 53/500
6,669,616 B1 * 12/2003 Bierenacki ..... B31B 50/802 493/309
(Continued)

FOREIGN PATENT DOCUMENTS

CN 105129125 A 12/2015
CN 205833652 U 12/2016
(Continued)

OTHER PUBLICATIONS

The International Bureau of WIPO, International Preliminary Report on Patentability, International Application No. PCT/IB2021/000741, mailed May 11, 2023 (12 pages).
(Continued)

*Primary Examiner* — Andrew M Tecco
(74) *Attorney, Agent, or Firm* — Wood Herron & Evans LLP

(57) ABSTRACT

A method for packaging products in boxes comprises the steps of:
a) providing a plurality of boxes in a folded configuration,
(Continued)

b) collecting one box in the folded configuration and modifying the configuration thereof so as to bring it into an open configuration which is suitable for containing said products,
c) verifying the conformity of the box in the open configuration with at least one predetermined quality parameter, and
d) if the box in the open configuration complies with the quality parameter, introducing the products into the box, otherwise
e) if the box in the open configuration does not comply with the quality parameter, returning the box to the folded configuration.

9 Claims, 8 Drawing Sheets

(51) Int. Cl.
*B65B 43/26* (2006.01)
*B65B 43/54* (2006.01)
*B65B 57/04* (2006.01)

(56) References Cited

U.S. PATENT DOCUMENTS

2007/0072756 A1* 3/2007 Monti ..... B65B 59/003
493/309
2017/0293291 A1* 10/2017 Diehr ..... B31B 50/006

FOREIGN PATENT DOCUMENTS

CN 107054754 A 8/2017
CN 110508505 A 11/2019
CN 110789762 A 2/2020
EP 1935790 A1 * 6/2008 ..... B65B 43/285

OTHER PUBLICATIONS

European Patent Office, International Search Report and Written Opinion of the International Searching Authority, International Application No. PCT/IB2021/000741, mailed Jun. 14, 2022 (16 pages).

* cited by examiner

METHOD FOR PACKAGING PRODUCTS IN BOXES AND PACKAGING APPARATUS OPERATING ACCORDING TO THIS METHOD

CROSS-REFERENCE TO RELATED APPLICATIONS

The present application is a submission under 35 U.S.C. § 371 of International Application No. PCT/162021/000741, filed Oct. 26, 2021, which claims priority to Italian Application No. 102020000025924, filed Oct. 30, 2020, and Italian Application No. 102020000025912, filed Oct. 30, 2020, and also claims the filing benefit of U.S. Provisional Application Ser. No. 63/105,417, filed Oct. 26, 2020, and U.S. Provisional Application Ser. No. 63/105,426, filed Oct. 26, 2020, the disclosures of which are incorporated herein by reference in their entireties.

FIELD OF THE INVENTION

The present invention relates to a method for packaging products in boxes, in particular for inserting a plurality of products inside packaging boxes of suitable size to facilitate the storage and the transport thereof.

The present invention is also directed to a packaging apparatus operating according to this method.

BACKGROUND OF THE INVENTION

The present invention finds a preferred, though not exclusive, application in the sector of packaging in boxes of packagings containing a plurality of loose articles, such as for example capsules for infusion type beverages, for example coffee, a sector to which reference can be made hereinafter without losing generality.

In particular, in the relevant technical field, it is known to place a predefined plurality of capsules inside suitable packagings prepared for sale to the public. In order to facilitate the movement operations of such packagings, particularly during the storage and transport steps from the production plant as far as the final point of sale, it is known to place an appropriate number of such packagings inside packaging boxes, typically cardboard boxes.

For this purpose, packaging apparatuses are known which collect packagings of capsules typically coming from a production line and introduce them, according to a predefined configuration, into packaging boxes. The latter are typically supplied to the packaging apparatuses in a folded configuration, with the panels that form the base of the box that are open and with the lateral panels of the box that are joined together but rotated with respect to each other so that each lateral panel forms with the lateral panels adjacent thereto a substantially zero or substantially flat angle. In this way, a substantially sheet-like structure is obtained, which is particularly compact and which is formed by two superimposed pairs of adjacent and coplanar lateral panels. Generally, the packaging apparatuses are supplied with stacks of boxes in a folded configuration and comprise an unfolding station in which the boxes, before being sent to a packaging introduction station, are suitably "put in volume", for example by rotating the lateral panels so as to be perpendicular to each other.

In this description as well as in the accompanying claims, certain terms and expressions are deemed to have, unless otherwise expressly indicated, the meaning expressed in the following definitions.

The term "product" means any solid product capable of being packaged in packaging boxes.

The products can be identical to each other, or they can differ in some characteristics such as for example the formation, the composition, the colour or their orientation.

Preferably, the products are, in turn, box-like packagings containing articles intended for retail sale, such as for example food and confectionery products, already packaged in individual containers or wrappers, such as capsules of coffee or other infusion type coffee, bottles and cartons of beverages, jars of yoghurt, single chocolates (wrapped or bare), candies, pouches containing solid, liquid or semi-solid food products; in addition, products from the ceramic industry, absorbent products for hygienic use, products from the tobacco industry, products from the cosmetic industry, products from the pharmaceutical industry, products from the personal & home care industry.

"B ox" means any container suitable for containing a plurality of products for the purpose of their packaging, which is capable of passing from a folded configuration to an open configuration.

Preferably, the box is made of cardboard and is formed by a succession of lateral panels joined together at the opposite sides and by one or more base panels, joined to one or more sides of the lateral panels.

Preferably, each lateral panel is joined to a pair of adjacent lateral panels at respective creases defining the opposite sides of the lateral panel. Preferably, each pair of lateral panels can oscillate around the respective crease that joins them.

A box is said to be in a "folded configuration" when each lateral panel of the box is rotated with respect to the adjacent lateral panels so that each lateral panel forms a substantially zero or substantially flat angle with the lateral panels adjacent thereto, so that two adjacent lateral panels are substantially coplanar or overlapping one another.

In this way, the box in the folded configuration has a substantially sheet-like conformation, with two main dimensions and a substantially smaller dimension than the other two.

A box is said to be in the "open configuration" when each lateral panel of the box is rotated with respect to the adjacent lateral panels so as to define an internal volume of the box, which is closed laterally by the lateral panels, in which the products to be packaged can be inserted.

A box, in particular a box in the open configuration, "complies" with at least one predetermined quality parameter when it meets a specific functional requirement. Preferably, the verified quality parameter is useful to verify the suitability of the box to accommodate the products to be packaged.

In this sense, the characteristic being controlled is to be understood in a general sense and, in particular, can be both a characteristic measurable in quantitative terms (such as for example a weight or a dimension) and assessable in qualitative terms (such as for example the integrity or the presence or, again, the shape or the orientation of the box or one of its components).

A first direction is said to be "substantially" perpendicular to a second direction when they are inclined to each other at an angle between 80° and 100°.

Similarly, two directions are said to be "substantially" parallel or are inclined to each other by a "substantially" zero angle, when they are inclined to each other as far as a maximum of 10°.

The Applicant has observed that in a packaging apparatus for packaging products such as those briefly described above, the step of unfolding the boxes, where they are brought from the folded configuration to the open configuration, constitutes a particularly critical step for the correct functioning of the process.

The Applicant has in fact observed that the opening of the box can be hindered by several factors, often depending on the quality of the boxes which can vary widely in terms of material, quality of the creases, quality and precision of the gluing.

The Applicant has also verified that failure to open the box (or the incorrect opening thereof) may cause the packaging apparatus to block and require the direct intervention of the operator to remove the box from the packaging line.

Furthermore, the Applicant has noted that a significant proportion of machine downtimes during the packaging step is attributable to drawbacks caused by an incorrect unfolding of the box.

The Applicant has therefore perceived that in order to improve the overall efficiency of the packaging process, it is necessary to introduce corrective measures in the packaging process that allow to automatically manage any failure to open the box (or the incorrect opening thereof) without necessarily stopping the apparatus and requiring the manual intervention of the operator.

Finally, the Applicant has found that a method in which it is provided for the control of the correct opening of the box before inserting the products in its inside and, if the control should show some non-conformity, it is provided for the return of the box to the folded configuration, allows to manage this undesired event in an optimal way without stopping the apparatus.

SUMMARY OF THE INVENTION

In a first aspect thereof, therefore, the present invention is directed to a method for packaging products in boxes.

Preferably, this method comprises the step of providing a plurality of boxes in a folded configuration.

Preferably, this method comprises the step of collecting one of said boxes in a folded configuration from said plurality.

Preferably, this method comprises the step of modifying the configuration of said box so as to bring it into an open configuration, which is suitable for containing said products.

Preferably, this method comprises the step of verifying the conformity of said box in the open configuration with at least one predetermined quality parameter.

Preferably, if said box in the open configuration complies with said at least one quality parameter, this method comprises the step of introducing said products into said box.

Preferably, if said box in the open configuration complies with said at least one quality parameter, this method comprises the step of returning said box to the folded configuration.

Thanks to these characteristics, the method according to the present invention optimally prepares the box that has been found as not conforming for the subsequent treatments envisaged by the process without blocking the packaging apparatus and without requiring the intervention of an operator.

In particular, the Applicant has envisaged that the box that has been found as not conforming can be rejected directly or can be subjected to one or more attempts to restore the open configuration and, in both cases, he has verified that starting from the folded configuration proves to be the best in terms of simplicity and repeatability of the operations as well as of optimisation of the overall dimensions.

In a second aspect thereof, the present invention relates to a packaging apparatus for packaging products in boxes.

Preferably, said apparatus comprises a supply unit of boxes in folded configuration.

Preferably, said apparatus comprises a gripping device, which is provided to collect one of said boxes in the folded configuration from said supply unit.

Preferably, said gripping device is provided to move said box onto a support plane.

Preferably, said apparatus comprises an unfolding mechanism which is provided to modify the configuration of said box by bringing it from said folded configuration to an open configuration.

Preferably, said apparatus comprises a folding mechanism, which is provided to modify the configuration of said box by bringing it from said open configuration to said folded configuration.

Preferably, said apparatus comprises a control unit which is provided to verify the conformity of said box in the open configuration with at least one predetermined quality parameter.

Preferably, said control unit is provided to actuate said folding mechanism of said box when said box in the open configuration does not comply with said at least one quality parameter.

In this way, the apparatus of the present invention is able to operate automatically in accordance with the method of the preceding aspect, without the need for external interventions by an operator.

In a third aspect thereof, the present invention relates to a packaging apparatus for packaging products in boxes.

Preferably, said apparatus comprises a supply unit of boxes in folded configuration.

Preferably, said apparatus comprises a gripping device, which is provided to collect one of said boxes in the folded configuration from said supply unit and move it onto a support plane.

Preferably, said apparatus comprises a carriage, comprising said support plane.

Preferably, said carriage comprises at least one retention element for said box on said support plane.

Preferably, said apparatus comprises an unfolding mechanism which is provided to modify the configuration of said box by bringing it from said folded configuration to an open configuration.

Preferably, said unfolding mechanism modifies the configuration of said box by moving said gripping device and said carriage.

Preferably, said apparatus comprises a conveyor device which is provided to bring said box in the open configuration into an insertion station for inserting said products in said box.

Preferably, said carriage can be moved between a first position, in which it receives said box in a folded configuration, and a second position, in which it delivers said box in the open configuration to said conveyor device.

Preferably, in said first position, said carriage is spaced apart from said conveyor device.

Preferably, in said second position, said carriage is near said conveyor device.

Thanks to these features, the packaging apparatus of the present invention enables folded boxes to be opened precisely and accurately, and at the same time offers high production capacities.

In particular, the provision of using the support plane of a movable carriage to bring the box into an open configuration makes it possible to separate the step of putting the box in volume from the transport thereof to a subsequent insertion station for inserting the products. In this way, the box arrives on the conveyor device in an already open configuration and the conveyor device can be suitably sized to support and move the open box with precision, without the need to plan the dimensions and the tolerances required to allow the deposit of the box in a folded configuration thereon and its subsequent opening.

In a fourth aspect thereof, therefore, the present invention is directed to a method for packaging products in boxes.

Preferably, this method comprises the step of providing a plurality of boxes in a folded configuration.

Preferably, this method comprises the step of collecting one of said boxes in a folded configuration from said plurality.

Preferably, this method comprises the step of modifying the configuration of said box so as to bring it into an open configuration, which is suitable for containing said products.

Preferably, this method comprises the step of verifying the conformity of said box in the open configuration with at least a first predetermined quality parameter.

Preferably, if said box in the open configuration complies with said at least a first quality parameter, this method comprises the step of sending said box to the insertion of said products.

Preferably, if said box in the open configuration does not comply with said at least a first quality parameter, this method comprises the step of rejecting said box.

Thanks to these features, this further method according to the present invention immediately removes the box that has been found as not conforming from the packaging process, preventing it from reaching the subsequent treatments envisaged by the process where it might be the cause of inconveniences, such as jammings of the packaging apparatus and/or product waste.

In a fifth aspect thereof, the present invention relates to a packaging apparatus for packaging products in boxes.

Preferably, said apparatus comprises a supply unit of boxes in folded configuration.

Preferably, said apparatus comprises an unfolding mechanism which is provided to modify the configuration of one of said boxes by bringing it from said folded configuration into an open configuration which is suitable for containing said products.

Preferably, said apparatus comprises an insertion station for inserting said products in said box.

Preferably, said apparatus comprises a first rejection station of said box.

Preferably, said apparatus comprises a control unit which is provided to verify the conformity of said box in the open configuration with at least a first predetermined quality parameter.

Preferably, said control unit is provided to send said box to said insertion station when said box complies with said at least a first quality parameter.

Preferably, said control unit is provided to send said box to said first rejection station when said box does not comply with said at least a first quality parameter.

In this way, the apparatus of the present invention is able to operate automatically in accordance with the method of the preceding aspect, without the need for external interventions by an operator.

In a sixth aspect thereof, the present invention relates to a packaging method for packaging products in boxes.

Preferably, said method comprises the step of forming a group of products intended to be introduced into a box.

Preferably, said method comprises the step of verifying the conformity of said group of products with at least one quality parameter referred to the insertion of said group in said box.

Preferably, if said group of products complies with said at least one quality parameter, said method comprises the step of introducing said group of products into said box.

Preferably, if said group of products does not comply with said at least one quality parameter, said method comprises the step of rejecting said group of products.

Thanks to these features, it is possible to detect any non-conformity of the group of products which is prepared for the insertion in the box, thus allowing its timely rejection without the attempt of inserting a non-conforming group of products into the box being able to cause damages to the box itself, which should therefore in turn be rejected, or the jamming of the apparatus with subsequent manual intervention by the operator.

The present invention, in at least one of the aforesaid aspects, may have at least one of the further preferred features set out below.

Preferably, once said box has been returned to its folded configuration, it is again brought into its open configuration.

In this way, a second attempt is made to open the box, avoiding its immediate rejection. In fact, it has been verified that even the boxes that do not open correctly on the first attempt can sometimes open correctly on a subsequent attempt, thus avoiding the rejection of a box. The appropriateness and validity of adopting this procedure can be assessed according to the type of boxes used and the production level required.

Preferably, said box that has been returned again to the open configuration is subjected to the verification of conformity and to the subsequent product introduction or folding steps according to the outcome of the verification.

In one embodiment it is provided to set a maximum number of attempts to reopen the non-conforming box before definitively rejecting said box. Preferably said maximum number is equal to or less than 3.

In one embodiment, said box, once it has been returned to its folded configuration, is rejected.

This prevents the products from being inserted into boxes that has been incorrectly opened, which would in any case be rejected at the end of the process together with the products, and which risk causing unwanted blockages to the packaging apparatus.

Preferably, the configuration of said box is modified from the folded state to the open state by means of an unfolding mechanism and, even more preferably, it is modified from the open state to the folded state by means of the same unfolding mechanism, operated in the opposite mode.

In this way, a single component can be used to perform both operations, with obvious savings in components and optimisation of the available resources.

Preferably, the configuration of said box is modified from the folded state to the open state by means of an unfolding mechanism and, during said verification of conformity, said box is maintained in engagement by said unfolding mechanism.

This feature advantageously allows the box to be folded immediately in the event of non-conformity of the box and it further helps to maintain the open configuration of the box.

In one embodiment, said controlled quality parameter is the correct orientation of at least one lateral panel of said box.

In this way, it can be easily and effectively controlled that the box has been opened correctly.

Preferably, said controlled quality parameter is the correct orientation of at least one base panel which extends from a respective lateral panel of said box.

In fact, in an open configuration box, the panels forming the opposite bases of the box extend from a respective lateral panel and the Applicant has observed that the correct orientation of the base panel requires the correct orientation of the lateral panel to which it is joined, while the reverse is not necessarily true.

Furthermore, the control of the orientation of a base panel is also useful independently of the control of the orientation of the lateral panel, since also the base panel is preferably positioned in a suitable way with respect to the respective lateral panel in order not to hinder the entry of the products into the open box.

It follows that the control of the orientation of the base panel actually allows verifying both the orientation condition of the base panel and the lateral panel from which it extends.

Preferably, said box is brought into an open configuration by maintaining a lower lateral panel on a support plane and moving an upper lateral panel, which is opposite said lower lateral panel, away from said support plane.

Preferably, said upper lateral panel is moved perpendicularly to said support plane, while said lower lateral panel is moved along said support plane.

This optimises the movement of the unfolding mechanism. In particular, the movement trajectory of a gripping device intended to move the upper lateral panel is minimised, thus allowing the box opening operations to be carried out at high speed and, consequently, to increase the production capacity of the packaging apparatus.

Preferably, said at least one base panel extends from said upper lateral panel of said box.

In this way, it is possible to verify the correct opening of the box also by controlling the correct orientation of only one panel, provided that the lower lateral panel remains retained on the support plane.

In one embodiment, the correct orientation of said lower lateral panel of said box is controlled. More preferably, the correct orientation of a base panel which extends from said lower lateral panel is controlled.

Preferably, the control on the lower lateral panel is additional to the control carried out on the upper lateral panel.

This ensures that the box has been opened correctly.

Preferably, the correct orientation of a base panel which extends from an upper panel and/or a lower panel at both opposite bases of said box is controlled.

In this way, the correct opening of the box can be further guaranteed.

In one embodiment, said method further comprises the steps of:

- forming a group of products intended to be introduced into said box in an open configuration,
- verifying the conformity of said group of products with at least a second quality parameter referred to the insertion of said group into said box, and
- if said group of products complies with said at least one second quality parameter, introducing said group of products into said box, while
- if said group of products does not comply with said at least a second quality parameter, rejecting said group of products.

In this way, it is possible to quickly define any non-conformity of the group of products prepared for the insertion in the box, thus enabling it to be promptly rejected without the attempt of inserting a non-conforming group of products into the box being able to cause damages to the box itself, which should therefore in turn be rejected, or the jamming of the apparatus with subsequent manual intervention by the operator.

Naturally, if a group of products is rejected, the box ready to accommodate a group of products inside it, is kept in position waiting for the formation of a new group of products and for its verification of conformity with the second quality parameter.

In a completely analogous way, when a box is rejected as it does not comply with the first quality parameter, the group of products that has been formed and which is ready to be inserted in a box, is kept in the waiting position until a new box that has been correctly opened arrives.

In one embodiment, said at least a second verified quality parameter is a dimension of said group of products.

In this way it is possible to use effective and inexpensive sensors, such as for example an optical sensor.

Preferably said dimension is the height of said group of products.

Preferably, said group of products, following said verification of conformity with said at least a second quality parameter, is moved towards an insertion station for inserting in said box or towards a second rejection station by the same movement device.

This advantageously allows to save mechanical components and to contain costs and overall dimensions.

In one embodiment, said packaging apparatus comprises a conveyor device which is provided to bring said box in the open configuration into an insertion station for inserting said products in said box.

Preferably, said conveyor device is of the step type, alternating movement steps with parking steps in the same position.

Preferably, said conveyor device comprises a plurality of supporting elements which are spaced apart uniformly in order to support said box in the open configuration.

Preferably, said support elements are mounted on at least one transport belt driven in rotation along a closed loop path.

Preferably, said support elements are spaced apart uniformly in order to support said box at a pair of opposite walls, a front wall and a rear wall, respectively of said box with respect to an advance direction of said conveyor device.

In one embodiment, said packaging apparatus comprises a first rejection station of said box folded by said folding mechanism.

In this way, the box that has been found as not conforming can be immediately rejected without interfering with the subsequent packaging steps and, in particular, the possibility that such a box may cause malfunctions or blockages in the packaging apparatus.

Preferably, said first rejection station is positioned near said carriage, more preferably it is positioned at the side opposite said conveyor device with respect to said insertion station.

Preferably, said first rejection station is positioned under said supply unit of boxes in folded configuration.

This optimises the overall dimensions of the apparatus. It will be noted that the provision of folding the box that has been found as not conforming before rejecting it allows containing the spaces required by the first rejection station.

In one embodiment, said first rejection station comprises a motorised belt, on which the folded box rests, and an upper contrast roller which keeps it pressed against the motorised belt.

This solution allows the overall dimensions required to be best contained and is particularly suitable for the rapid movement of an element with a sheet-like structure, such as that of a box in a folded configuration.

In alternative embodiments, said first rejection station comprises one or more webs and conveyor belts or a pusher element.

Of course, other solutions can be envisaged to effectively remove the boxes to be rejected.

For example, in one embodiment, the first rejection station may comprise an element that pushes the box to be rejected laterally bringing it out of the carriage, in particular into a discharge container.

Or, in another embodiment, the box to be rejected (folded or not) can be moved directly from the gripping device laterally to the outside of the carriage, for example into a discharge container.

Preferably, said apparatus comprises a gripping device, which is provided to collect one of said boxes in the folded configuration from said supply unit.

Preferably, said gripping device is provided to move said box onto a support plane.

In one embodiment, said gripping device comprises a plurality of gripping elements which are capable of retaining said box in the folded configuration.

Preferably, said gripping elements retain said box at two lateral panels that are adjacent to each other.

In this way, the box is firmly retained during the collection from the supply unit of boxes and during the subsequent transport towards the support plane.

Preferably, said gripping elements are of the suction cup type and are connected to a depressurisation circuit to retain said box by suction.

More preferably, said gripping elements are connected individually or in groups to said depressurisation circuit.

In this way it is possible to selectively activate or deactivate the gripping elements, advantageously allowing, for example, to retain both adjacent lateral panels of the box during the transport as far as the support plane and then to maintain in engagement only one of the two lateral panels, disengaging the other one, to allow the box to be put in volume.

In one embodiment, said support plane, on which said box is deposited in the folded configuration, is defined on a carriage which can be moved away from and towards said conveyor device.

Thanks to this feature, the packaging apparatus of the present invention enables folded boxes to be opened precisely and accurately, and at the same time offers high production capacities.

In particular, the provision of using the support plane of a movable carriage to bring the box into an open configuration makes it possible to separate the step of putting the box in volume from the transport thereof to a subsequent insertion station for inserting the products. In this way, the box arrives on the conveyor device in an already open configuration and the conveyor device can be suitably sized to support and move the open box with precision, without the need to plan the dimensions and the tolerances required to allow the deposit of the box in a folded configuration thereon and its subsequent opening.

Preferably, said carriage comprises at least one retention element which is provided to retain a panel of said box in a folded configuration at the opposite side with respect to said gripping device.

In this way, the box, during the opening step, is firmly retained at two opposite sides, one engaged by the gripping device and one engaged by the carriage.

In one embodiment, said support plane is formed by a plurality of said retention elements which are mounted on said carriage.

In an alternative embodiment, one or more of said retention elements are mounted on said carriage below said support plane.

In respective embodiments, the carriage may have the retention elements at the lower lateral panel, or at a base panel which extends from the lower lateral panel, or again at both panels.

The specific configuration of the retention elements can be conveniently chosen on the basis of the respective configuration of the carriage and of the other components of the apparatus with which it is intended to interact, such as for example the conveyor device or opening arms for the base panels.

In one embodiment, said carriage, when it is moved towards said conveyor device, is at least partially beside it.

Preferably, said carriage is at least partially beside said at least one conveyor belt, more preferably, is at least partially inserted between a pair of said conveyor belts.

In this way, the box can be delivered more precisely to the conveyor device, avoiding abrupt changes in direction or speed.

Preferably, an abutment element, which is provided to abut said box in a folded configuration at the side opposite said conveyor device, is provided on said carriage.

In this way, both the unfolding step of the box and the eventual folding step are made easier and safer.

Preferably, said apparatus comprises a folding mechanism, which is provided to modify the configuration of said box by bringing it from said open configuration to said folded configuration.

Preferably, said folding mechanism of said box is actuated by said control unit when said box in the open configuration does not comply with said at least a first quality parameter.

Preferably, said unfolding mechanism and said folding mechanism comprise said gripping device and said carriage.

In one embodiment, said control unit comprises at least a first sensor which is provided to detect the presence of a lateral panel of said box or a base panel which extends from said lateral panel.

This makes it possible to detect the presence and/or the orientation of the lateral panel or of the respective base panel, thus enabling the conformity of the open box to be verified effectively.

Preferably, said first sensor is an optical sensor.

Alternatively, it is envisaged that the first sensor may be of the capacitive or ultrasonic type or formed by electromechanical switches.

The optical sensor, however, has proved to be more suitable due to the detection speed, the compact overall dimensions and the low procurement and maintenance costs.

Preferably, said first sensor is positioned on a wing which is beside said conveyor device and which is intended to maintain said base panel in an open condition with respect to said lateral panel from which it extends.

In this way, the control of the orientation of the base panel can be carried out simply by verifying its presence in the position of engagement with the wing, given that in this position the base panel must necessarily assume the orientation imposed by the wing.

In one embodiment, said packaging apparatus comprises a composition station which is provided to form a group of products intended to be introduced into said box in an open configuration.

Preferably, said packaging apparatus comprises a second rejection station for rejecting groups of products.

Preferably, said control unit is provided to verify the conformity of said group of products with at least a second predetermined quality parameter, sending said group of products to said insertion station when said group of products complies with said at least a second parameter of quality, and sending said group of products to said second rejection station when said group of products does not comply with said at least a second quality parameter.

In this way, a control is also made on the composition of the groups of products intended to be packaged in the boxes before their insertion into the boxes.

This advantageously avoids the possibility that groups of products that have been formed incorrectly, e.g. with a missing product or a differently oriented product, can be inserted into a box, causing the entire packaging to be rejected subsequently or even the packaging apparatus to be blocked by a jamming at the insertion station.

Preferably, said control unit comprises at least a second sensor which is provided to detect a dimension of said group of products.

Preferably, said at least a second sensor is an optical sensor.

Alternatively, it is envisaged that the second sensor may be of the capacitive or ultrasonic type or formed by electromechanical switches.

Preferably, said packaging apparatus comprises a movement device which is provided to move said group of products towards said insertion station or towards said second unloading station.

BRIEF DESCRIPTION OF THE DRAWINGS

The characteristics and advantages of the present invention will become clearer from the detailed description of an embodiment shown, by way of non-limiting example, with reference to the appended drawings wherein.

DETAILED DESCRIPTION OF THE INVENTION

Figure 1:
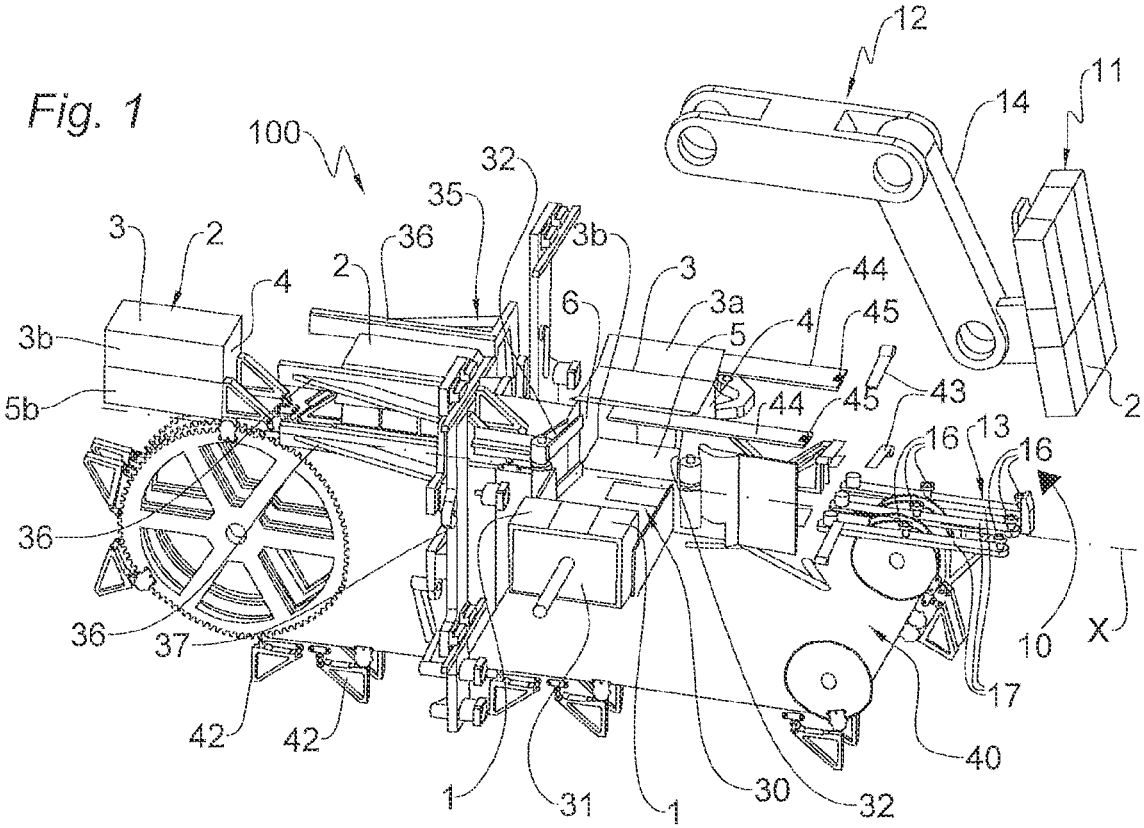
FIG. 1 is a partial schematic and top perspective view of a packaging apparatus for packaging products made in accordance with the present invention.

With reference to the enclosed figures, 100 denotes as a whole a packaging apparatus made in accordance with the present invention.

The packaging apparatus 100 is provided to package a plurality of products 1, loose, inside boxes 2 so as to prepare the final packaging for subsequent shipment.

The products 1 are represented, in this preferred embodiment, by box-like packagings of capsules for the production of infusion type beverages, in particular coffee. In particular, each box-like packaging 1 contains a predefined number of capsules and is intended for retail sale.

The packaging apparatus 100 comprises, in its more general units, a box formation station 10, where the boxes 2 are formed and provided to accommodate a group of products inside them, a station for composing the groups of products 20, in which the products 1 are suitably arranged in groups that are ready to be inserted into a box 2, and an insertion station 30, in which the groups of products 1 are inserted in the boxes 2.

The boxes 2 are made of cardboard, in a completely conventional manner, and each of them comprises four lateral panels 3, 4, 5 and 6, joined one after the other, at their respective opposite sides defined by creases made in the cardboard, to form the lateral walls of the box 2. From each lateral panel 3, 4, 5 and 6, respective base panels 3*a*-3*b*, 4*a*-4*b*, 5*a*-5*b* and 6*a*-6*b* extend from opposite sides, which can oscillate with respect to the respective lateral panel at the crease joining them.

In the folded configuration, the lateral panels are oscillated with respect to each other so that each lateral panel is coplanar to an adjacent lateral panel and folded overlapping with the other adjacent lateral panel, while the base panels extend from the respective lateral panels in a substantially coplanar manner with them, as clearly visible in the attached figures.

The box formation station 10 comprises a supply unit of boxes 11, in which a stack of boxes 2 is stored in a folded configuration, as well as a gripping device 12, which is provided to collect one of the boxes 2 present in the supply unit of boxes 11 and to move it onto a carriage 13.

The gripping device 12 preferably comprises an articulated arm 14, which is rotatable about several mutually parallel axes, at the free end of which a head provided with a plurality of gripping elements 15, which are arranged in several rows, is mounted.

In particular, it is provided that the gripping elements 15 are positioned to retain the box 2 in a folded configuration at two of its adjacent and coplanar lateral panels, denoted with 3 and 4.

The gripping elements 15 are preferably of the suction cup type, and are connected individually or in predefined groups to a depressurisation circuit to selectively retain the box 2 by suction.

Naturally, the gripping device 12 can be made in a different manner, for example by mounting the gripping elements 15 on a robotic arm.

The carriage 13 on which the box 2 collected by the gripping device 12 is deposited comprises a plurality of retention elements 16, which are provided to retain the box 2 in a folded configuration at the side opposite the gripping device 12.

In particular, the retention elements 16 are mounted on bars 17 which are parallel to each other and, as a whole, define a support plane of the box 2 deposited by the gripping device 12.

In the embodiment described herein, there are three bars 17 and extend at the base panels 5*a* and 6*a*, the lateral panels 5 and 6, and the base panels 5*b* and 6*b*, respectively.

In different embodiments, the bars 17 can be in a different number, depending on the type and sizes of boxes 2 used in the packaging process. In particular, when the boxes 2 are relatively small in size, only 2 bars can be provided.

Similarly to the gripping elements 15, the retention elements 16 are of the suction cup type, and are connected, individually or in predefined groups, to a depressurisation circuit to selectively retain the box 2 by suction.

The carriage 13, moreover, is movable between a first position, in which it receives the box 2 in the folded configuration, and a second position, in which it delivers the box 2 in the open configuration to a conveyor device 40 which is provided to bring the box 2 in the open configuration to the insertion station 30 along an advance direction X.

In particular, the carriage 13 is placed at one end of the conveyor device 40 opposite the insertion station 20 and its bars 17 extend parallel to the movement direction of the carriage, substantially coinciding with the advance direction X.

On the carriage 13, at the side opposite the conveyor device, there is also provided an abutment element 18, which is useful both to facilitate the correct positioning of the box 2 on the carriage 13 and to ensure the correct movement of the box 2 during its passage from the folded configuration to the open configuration.

The gripping device 12 and the carriage 13, thanks to their coordinated movement, form, as a whole, an unfolding mechanism which is provided to modify the configuration of the box 2 by bringing it from the folded configuration into the open configuration.

In particular, the gripping device 12, once the box has been deposited in the folded configuration on the carriage 13 and after having deactivated the gripping elements 15 corresponding to the lateral panel 4, lifts vertically, moving away from the support plane defined on the carriage 13. At the same time, the carriage 13, after having deactivated the retention elements 16 corresponding to the lateral panel 6, moves from the first position towards the conveyor device 40. In this way, the lateral panels of box 2 are rotated between them around the respective creases until they reach a condition of mutual perpendicularity, defining the opening configuration of the box 2.

In this configuration and with reference to the support plane and to the advance direction X, an upper lateral panel 3, a rear lateral panel 4, a lower lateral panel 5 (resting on the carriage 13) and a front lateral panel 6 (facing the conveyor device 40) can be identified in the box 2.

The gripping device 12 and the carriage 13 also form, as a whole, a folding mechanism, since by performing the same movement in the opposite direction, they can modify the configuration of the box 2, by returning it from the open configuration to the initial folded configuration.

The conveyor device 40 is of the step type, alternating movement steps with parking steps in the same position, and comprises a pair of transport belts 41, identical to each other, which are led in rotation along respective parallel and closed loop paths.

Support elements 42 are mounted uniformly on both transport belts 41 and which are advantageously secured to the respective transport belt in two distinct points and provided to support the box 2 in an open configuration in its advancement along the advance direction X both at one of its front wall and at one of its rear wall.

The distance and the dimensions of the transport belts 41 are such as to accommodate the central bar 17 of the carriage 13 between them, while the lateral bars 17 of the carriage 13 are placed side by side externally to the transport belts 41.

When the carriage 13 is moved to the second position, i.e. towards the conveyor device 40, the transport belts 41 are interposed between the bars 17, whereas when the carriage 13 is moved to the first position, i.e. away from the conveyor device 40, the bars 17 are partially outside the transport belts 41.

In the case of small-sized boxes 2, the transport belts 41 may be too close to allow a central bar to pass between them, so in this case, it is preferred that the carriage 13 provides only 2 lateral bars 17, which are placed side by side externally to the transport belts 41.

On the sides of the conveyor device 40 there are also provided spreading arms 43, which can be moved in oscillation in order to abut the base panels 3*a*-3*b* and 5*a*-5*b* and to rotate them in extra-opening with respect to the respective upper and lower lateral panels 3 and 5.

Immediately downstream of the spreading arms 43 there are also provided wings 44, sheet-like, which extend parallel to the plane of the conveyor device 40 and which are provided to maintain the respective base panels 3*a*-3*b* and 5*a*-5*b* in the extra-opening position as far as the insertion station 30.

A first optical sensor 45 is also mounted at the initial end of each wing 44 and which is provided to verify the presence of the respective base panel 3*a*-3*b* and 5*a*-5*b* on the correct side of the respective wing 44.

Further oscillating arms 46 are furthermore provided at the side of the conveyor device to rotate the base panels 4*a* and 6*a* inwardly of the box 2 perpendicularly to the respective lateral panels 4 and 6, so that the box 2 arrives at the insertion station 30 with the bottom partially formed.

In a position beside the supply unit of boxes 11, the packaging apparatus 100 comprises a supply unit 21 which is provided to bring a row of products 1 to the composition station 20, where the products 1 are arranged in groups prepared for the insertion into a box 2 in an open configuration brought by the conveyor device 40 in the insertion station 30.

The composition station 20 comprises a lifting device 22, which is positioned at the end of the supply unit 21 and provided to simultaneously lift a predefined number of products 1 as far as a bundling member 23 which is positioned above the supply unit 21. The bundling member 23 comprises lateral support shelves in order to retain the products 1 lifted by the lifting device 22 in place. Moreover, these support shelves are retractable so as to allow the row of retained products 1 to be lifted when a new row of products 1 is lifted by the lifting device 22, positioning itself under the row retained by the bundling member. In this way, a group of products 1 arranged in overlapping rows can be formed on the bundling member 23.

Figure 9:
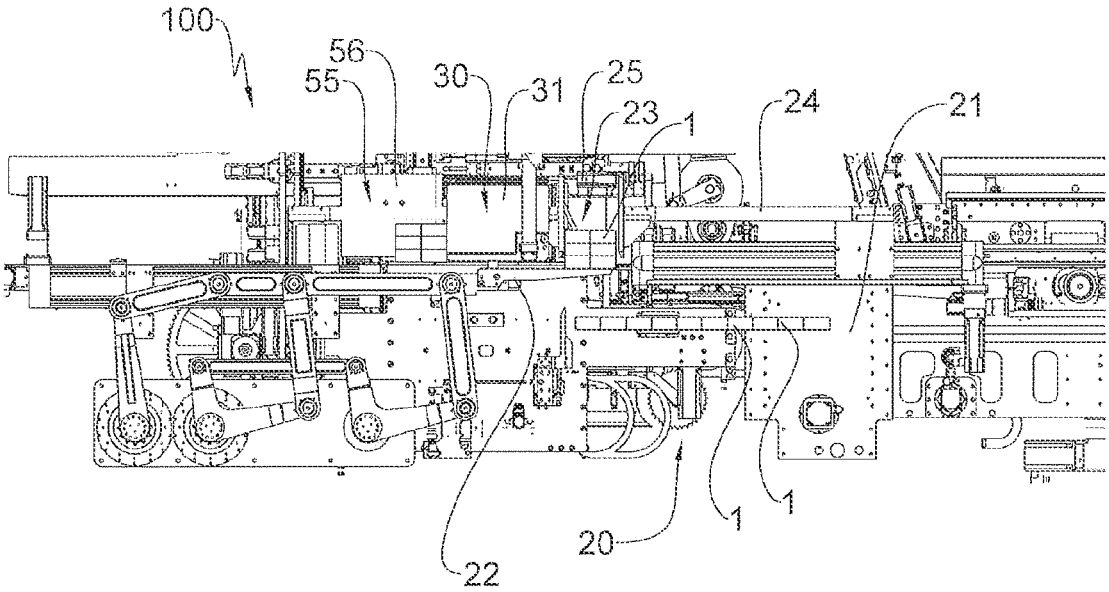
FIGS. 9 and 10 are partial schematic and side elevation views of the packaging apparatus of FIG. 1, in respective operating positions illustrating various components with respect to the previous figures.
Figure 10:
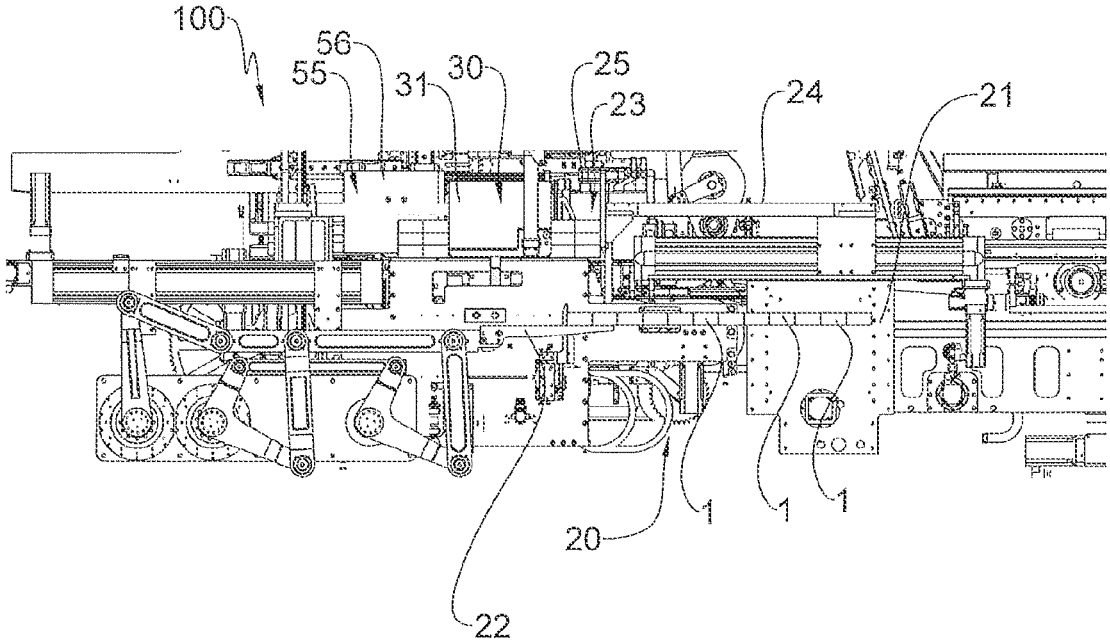

The composition station 20 (represented in FIGS. 9 and 10) further comprises a movement device 24 which, upon completion of the predefined number of rows of products 1, pushes the group of products from the bundling member 23 as far as the insertion station 30.

A second sensor 25 is further provided at the bundling member 23 and which is provided to detect the correct size of the group of products 1 before it is moved to the insertion station 30.

In the insertion station 30, the groups of products 1 pushed by the movement device 24 are in alignment with a box 2 in the open configuration, and, by means of a further pushing member 31, the group of products 1 is introduced into the box 2 through an open base thereof.

For this purpose, a pair of oscillating arms 32 are further envisaged in the insertion station 30 and which are provided to open the base panels 4*b* and 6*b* before insertion of the group of products 1 and then to close them again as soon as the group of products 1 is introduced.

Downstream of the insertion station 30, there is provided a closing unit 35 where the boxes 2, containing the products 1, are closed and sent for shipment. In particular, the closing unit 35 comprises adhesive dispensers (not represented) which are provided to apply glue dots on the base panels 4*a*, 4*b* and 6*a*, 6*b*, already rotated into the closing position of the bases of the box 2.

The closing unit 35 further comprises arms 36 which are mounted on supports 37 placed at the sides of the conveyor device 40 and which can be moved to rotate the base panels 3*a*, 3*b* and 5*a*, 5*b* inwardly of the box 2, perpendicularly to the respective lateral panels 3 and 5, and to push them against the base panels 4*a*, 4*b* and 6*a*, 6*b* respectively (on which glue dots are applied) so as to close the bottom and the top of the box 2.

In order to facilitate the correct closing operation of the base panels 3*a*, 3*b* and 5*a*, the closing unit 35 further comprises a squaring device (not represented) for squaring the box 2. The squaring device comprises fingers that extend vertically from the top towards the conveyor device 40 and that are provided to abut the front and rear lateral panels 4 and 6 at their upper region and keep them in a condition of perpendicularity with respect to the lower and upper lateral panels 3 and 5. These fingers can advantageously be oscillated to allow the box 2 to enter and exit the closing unit 35 and, preferably, are mutually positioned at an adjustable distance, so as to perform their function on boxes of different sizes.

The squaring device is provided to oscillate the fingers against the lateral panels 4 and 6 before the base panels 3*a*, 3*b* and 5*a*, 5*b* are pushed by the arms 36 against the base panels 4*a*, 4*b* and 6*a*, 6*b*, so that the box 2 is perfectly squared before its final closure.

The packaging apparatus 100 further comprises a first rejection station 50 (represented in FIGS. 11 to 14), which is provided to reject any boxes 2 that are not conforming upon a verification of their correct opening, as described in more detail below.

The first rejection station 50 is positioned near the carriage 13 at the side opposite the conveyor device 40, substantially under the supply unit of boxes 11 and comprises a pair of motorised belts 51 which in cooperation with respective upper contrast rollers 52, are provided to transport the box 2 in a folded configuration away from the carriage 13, for example towards a discharge container (not represented).

The packaging apparatus 100 further comprises a second rejection station 55, which is provided to reject any groups of products 1 that are not conforming upon a verification of their correct composition, as described in more detail below.

The second rejection station 55 is positioned at the side of the insertion station 30, at the side opposite the movement device 24, and comprises a pusher element 56 which is provided to push the group of products to be rejected into a discharge container 57.

In the packaging apparatus 100, there is also provided a third rejection station, which is positioned on the supply unit 21 of the products 1 upstream of the composition station 20, as well as a fourth rejection station 58 which is positioned downstream of the closing station 35.

In particular, the third rejection station is provided to reject any products 1 that are incorrectly positioned on the supply unit 21, for example rotated on themselves. The correct positioning of the products on the supply unit 21 can be controlled in line, for example by means of an optical sensor, and in the event of non-conformity, a rejection member, for example a lateral diverter, can be commanded, which removes the non-conforming product from the supply unit 21.

The fourth rejection station 58, on the other hand, is provided to reject any boxes 2 containing a group of products 1 that are not packaged correctly, for example due to a failure to glue the base panels.

The packaging apparatus 100 further comprises a control unit (not represented in the figures) which is provided to receive and process the signals received from the sensors or from the operator and to consequently command the movement of the various components of the apparatus according to a programmed operating mode described below.

Figure 2:
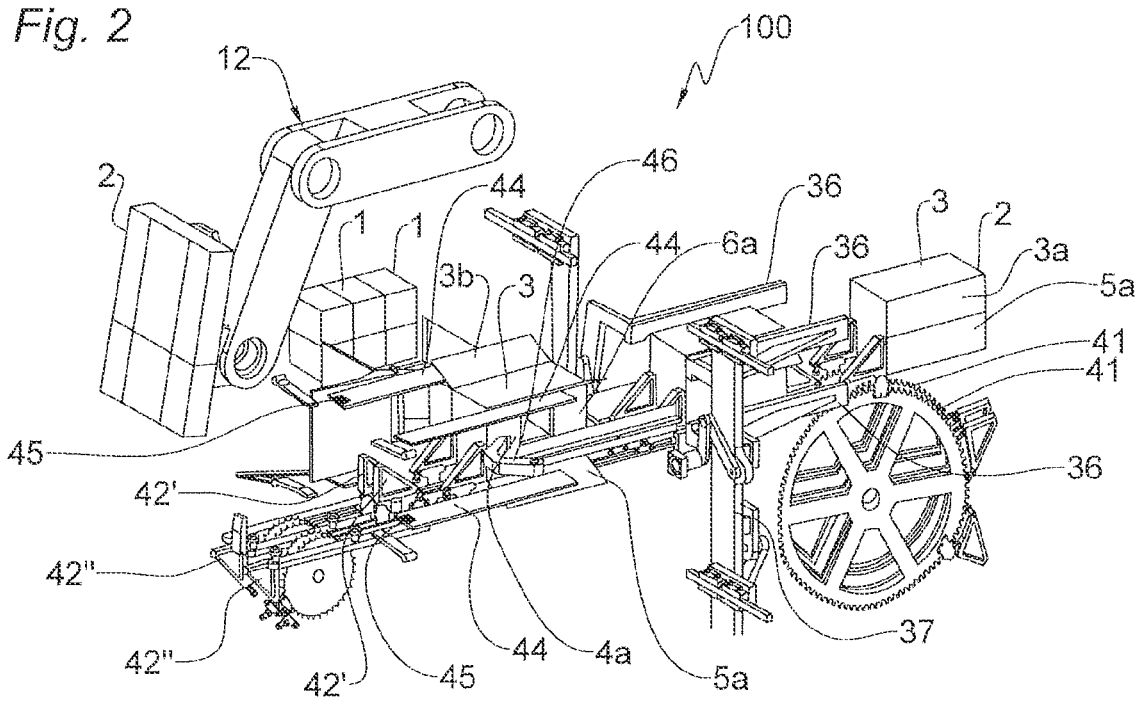
FIG. 2 is a partial schematic and top perspective view of the packaging apparatus of FIG. 1 from another point of view.

In an initial configuration of the packaging apparatus (FIGS. 1 and 2), the carriage 13 is in the first position, spaced apart from the conveyor device 40 which, in turn, is stationary in a position of waiting for a box in the open configuration, with a first support element 42' ready to abut a front wall of this box (in this example represented by the front lateral panel 6) and a second support element 42" which is ready to abut a rear wall of this box (in this example represented by the rear lateral panel 4) not yet rotated by the respective transport belt 41, so as to result at a level just below the support plane of the carriage 13 and not to hinder the subsequent movement of the box 2 towards the conveyor device 40.

Figure 3:
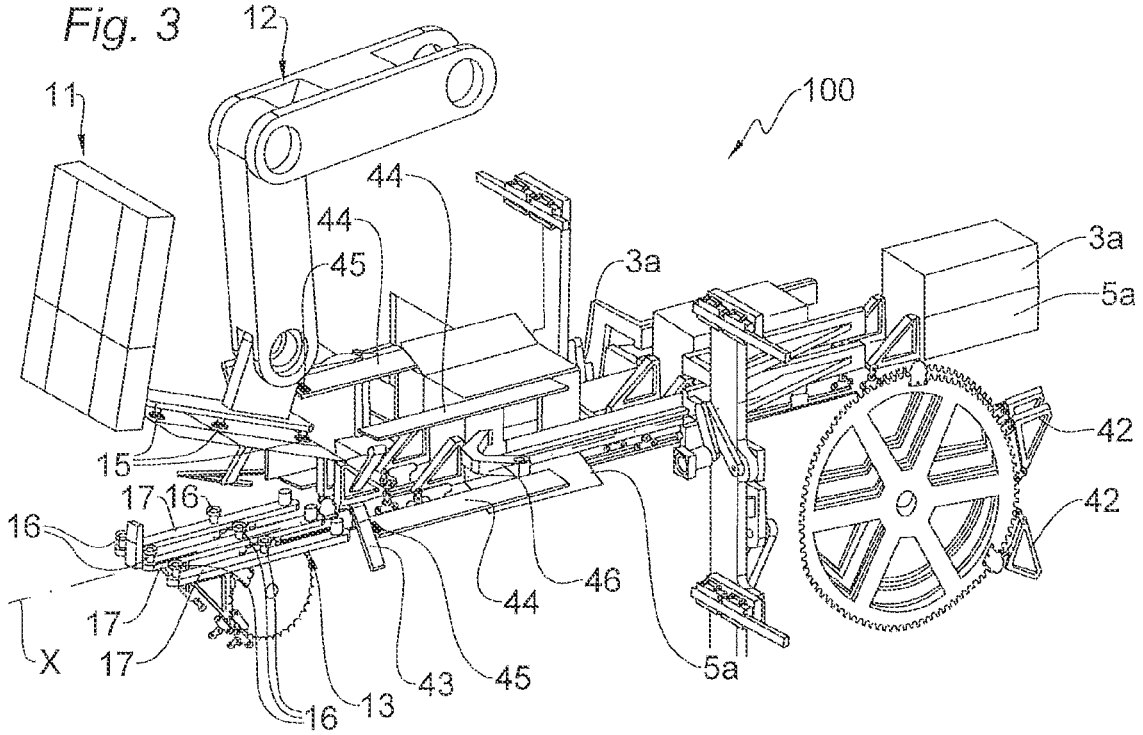
FIGS. 3 to 8 are schematic views of the packaging apparatus of FIG. 2 in successive operating positions.
Figure 4:
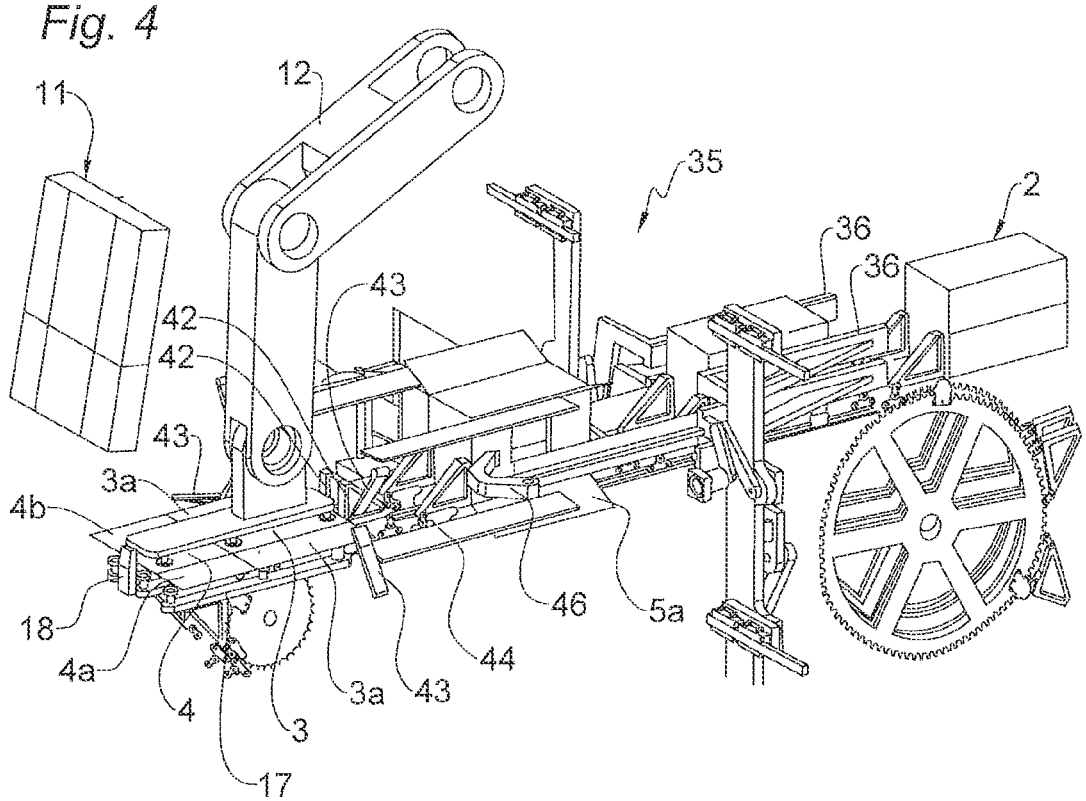

The gripping device 12 then collects a box 2 in the folded configuration from the supply unit of boxes 11, retaining the adjacent lateral panels 3 and 4 with its gripping elements 15 (FIG. 3), and deposits it on the carriage 13, on the support plane defined by its retention elements 16 (FIG. 4) which retain the box at both the lateral panels 5 and 6 and the respective base panels 5*a*, 5*b* and 6*a*, 6*b*.

In this position, the box 2 in the folded configuration has one of its joining side between the lateral panels 3 and 6 which is substantially lying against the support element 42' while the opposite side, joining the lateral panels 4 and 5 is substantially lying against the abutment element 18.

Figure 5:
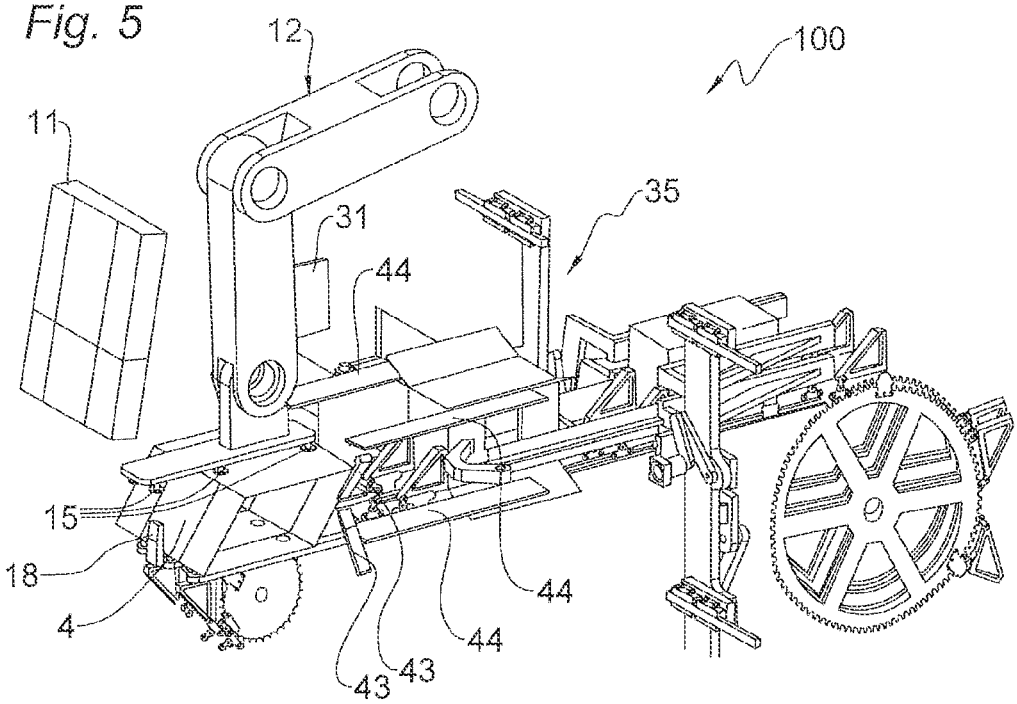
Figure 6:
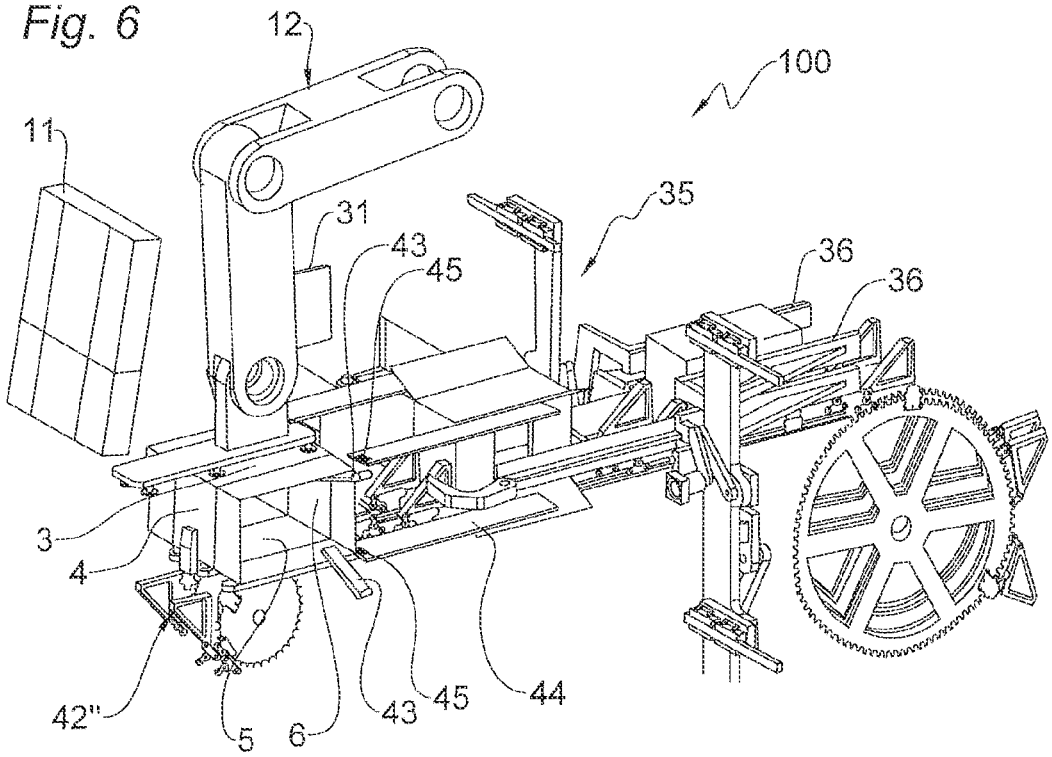

At this point, the gripping device 12 and the carriage 13, after having selectively deactivated the gripping and retention elements corresponding to the lateral panels 4, 6 and to the base panels 6*a* and 6*b*, are moved as described above to modify the configuration of the box 2 and to bring it into the open configuration (FIGS. 5 and 6).

Once the opening of the box 2 has been completed, the conveyor device 40 is set in motion along the advance direction X and simultaneously the gripping device 12 and the carriage 13 move together with it to keep the box 2 in a position lying against the support element 42'. This simultaneous movement of the gripping device 12 and the carriage 13 allows the box 2 to be accompanied, keeping it in the correct open configuration, until the support element 42" has completed its rotation, placing itself close to the rear lateral wall 4.

In the first step of this movement, the spreading arms 43 are actuated, which rotate the base panels 3*a*-3*b* and 5*a*-5*b* into extra-opening. In order not to hinder the opening of the latter, the lateral bars 17 of the carriage 13 disengage from the respective base panels and are lowered.

Figure 7:
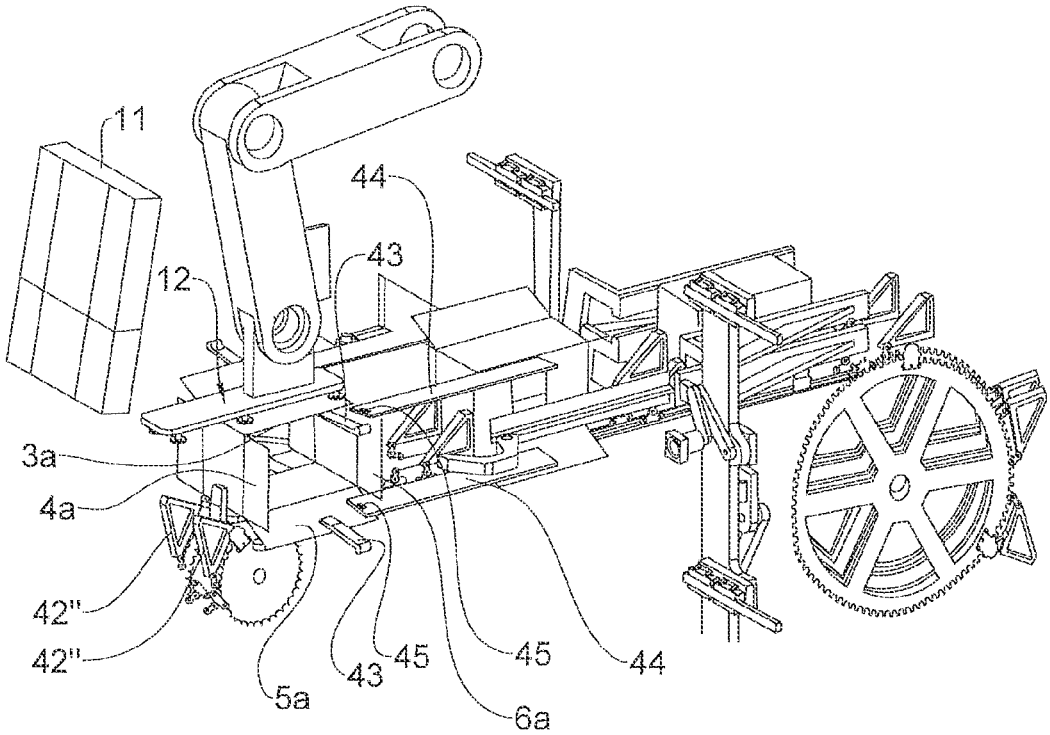
Figure 8:
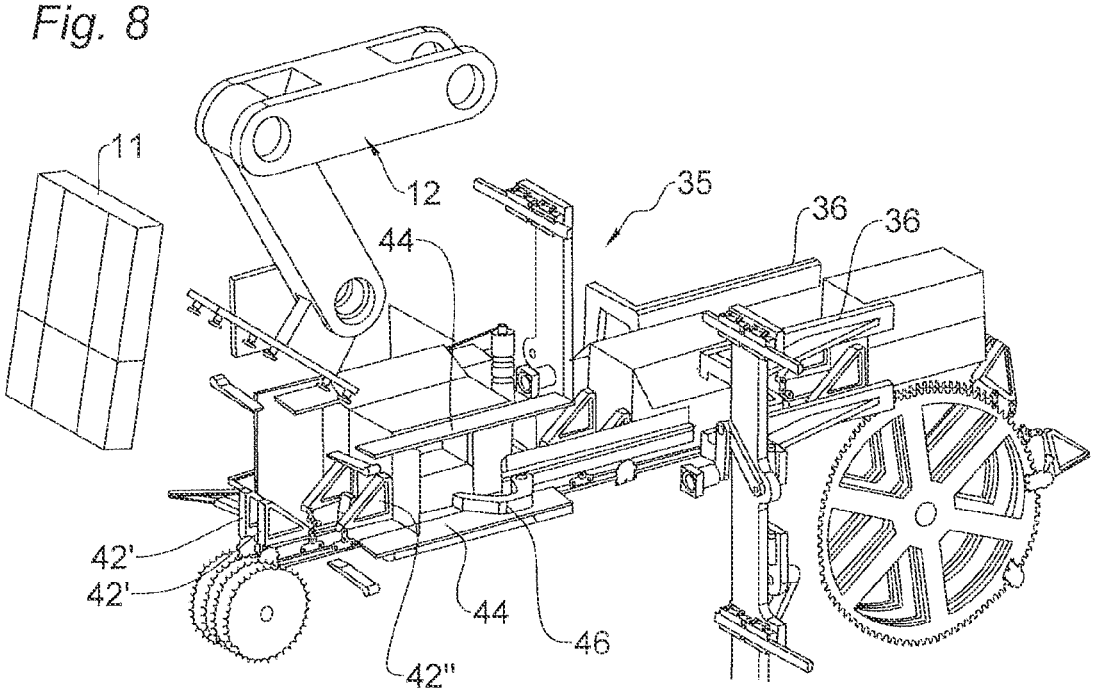

The base panels 3*a*-3*b* and 5*a*-5*b* are then guided respectively above and below the wings 44, so as to maintain the extra-opening position given by the spreading arms (FIG. 7).

At this point the first sensors 45 placed on the wings 44 detect the presence of the base panels 3*a*-3*b* and 5*a*-5*b* and, consequently, the control unit is able to verify whether the respective lateral panels 3 and 5 are correctly oriented and, ultimately, whether the box 2 has been opened correctly.

If the verification is positive, then, the box is sent to the next steps of the packaging process, which envisage, as previously described, the advancement of the conveyor device 40, the rotation for closing the base panels 4*a* and 6*a* carried out by the oscillating arms 46, the arrival at the insertion station 30 where a group of products 1, which has been prepared in the meantime in the composition station 20, is introduced into the open box 2 and then the closure of the other base panels at the closing unit 35.

If, on the other hand, the verification is negative, for example if any of the first sensors 45 does not detect the presence of the corresponding base panel, then the control unit will command the folding procedure of box 2.

Figure 11:
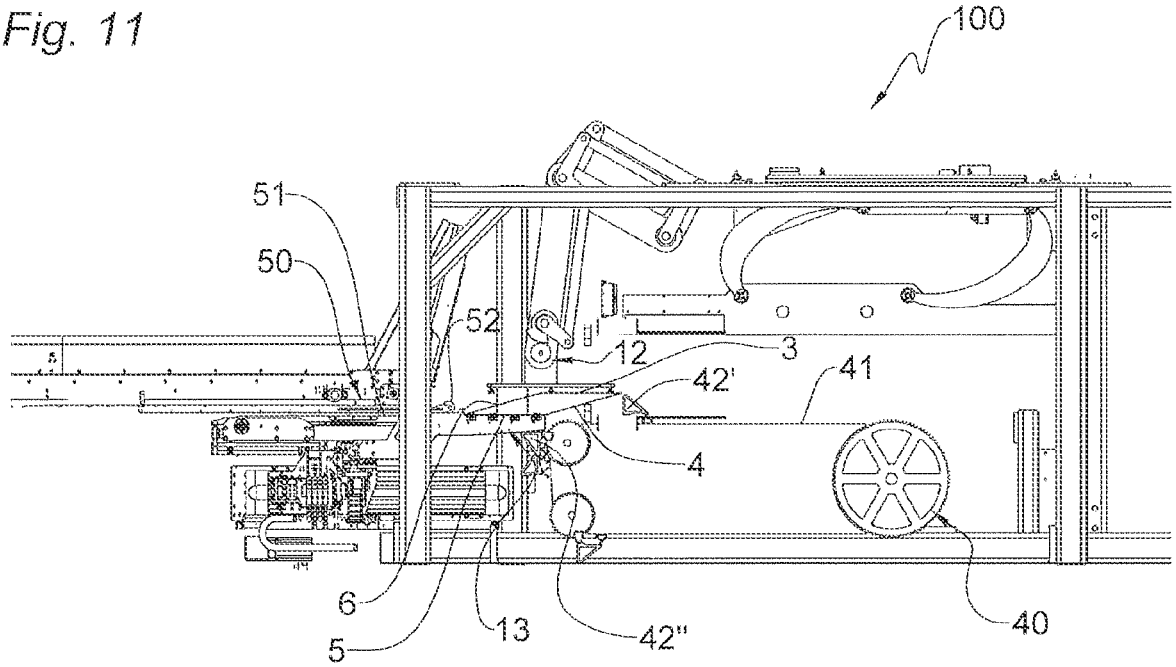
FIGS. 11 and 14 are partial schematic and side elevation views of the packaging apparatus of FIG. 1, in respective operating positions, illustrating additionally various components with respect to the previous figures.
Figure 12:
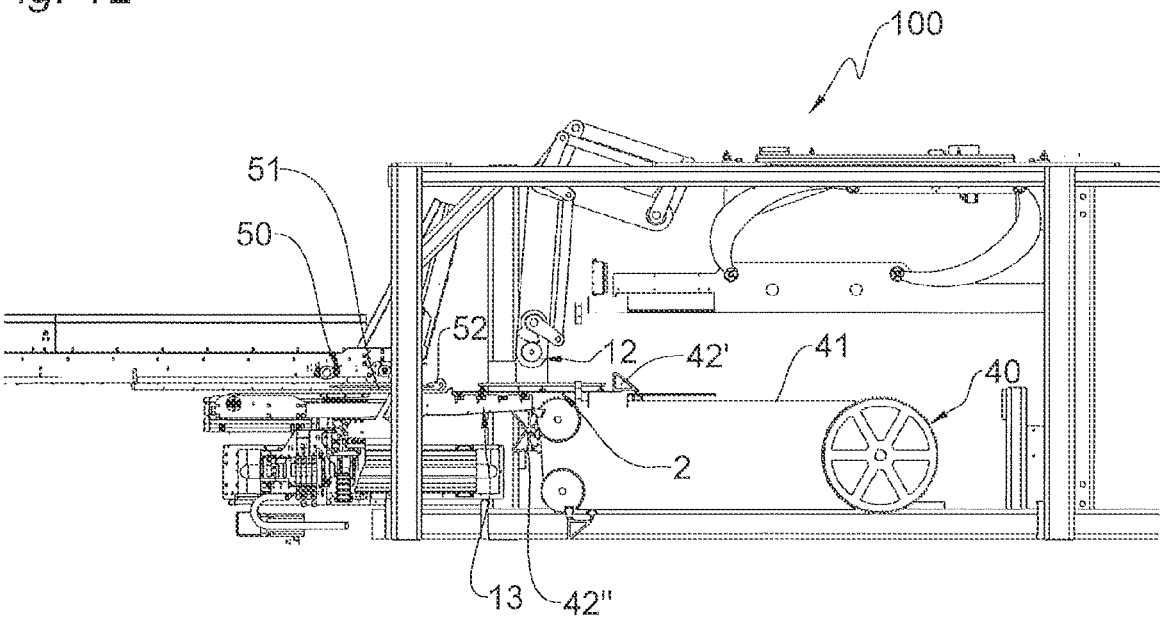

This involves moving the carriage 13 towards the first position and simultaneously lowering the gripping device 12, so as to repeat the movement made to open the box 2 in reverse (FIG. 11).

Figure 13:
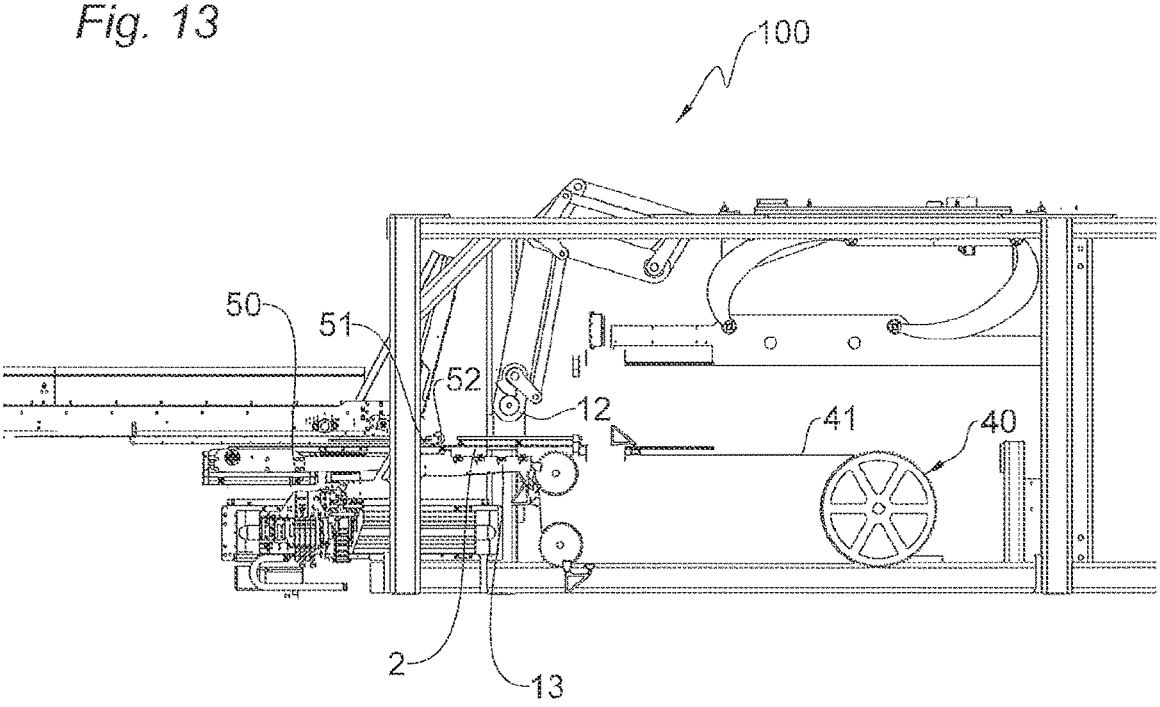
Figure 14:
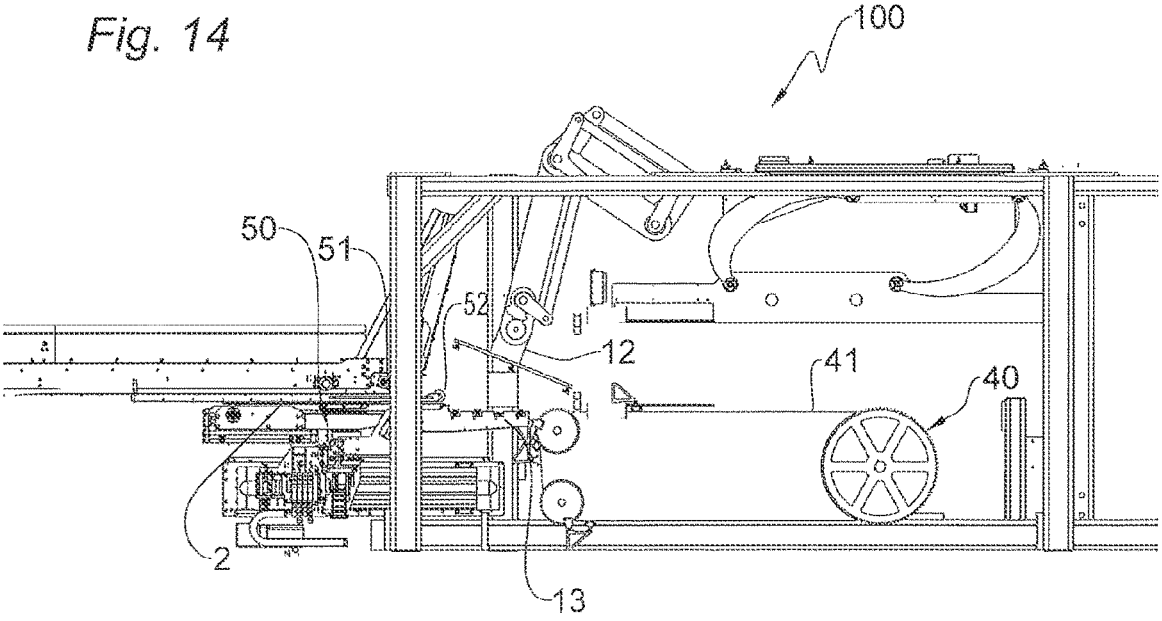
Figure 15:
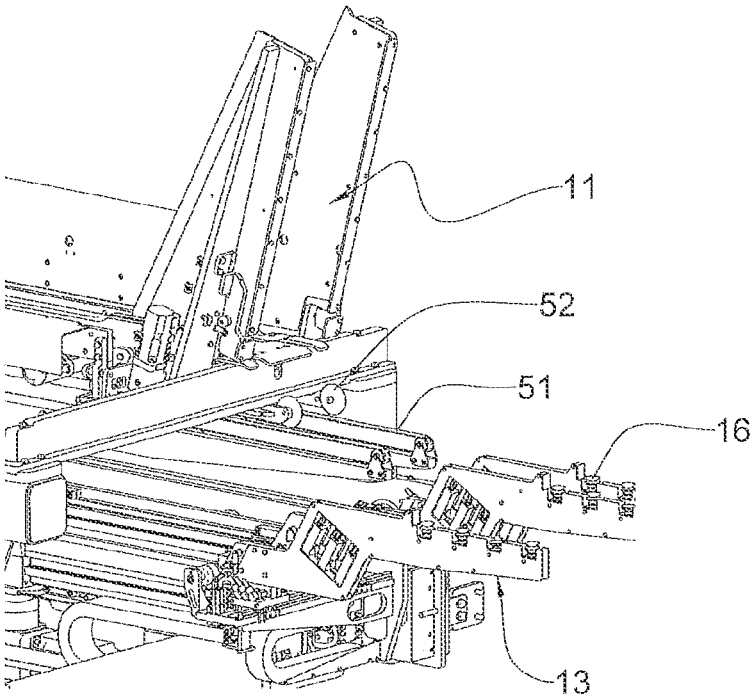
FIG. 15 is a schematic perspective view of a detail of the packaging apparatus of FIG. 1.
Figure 16:
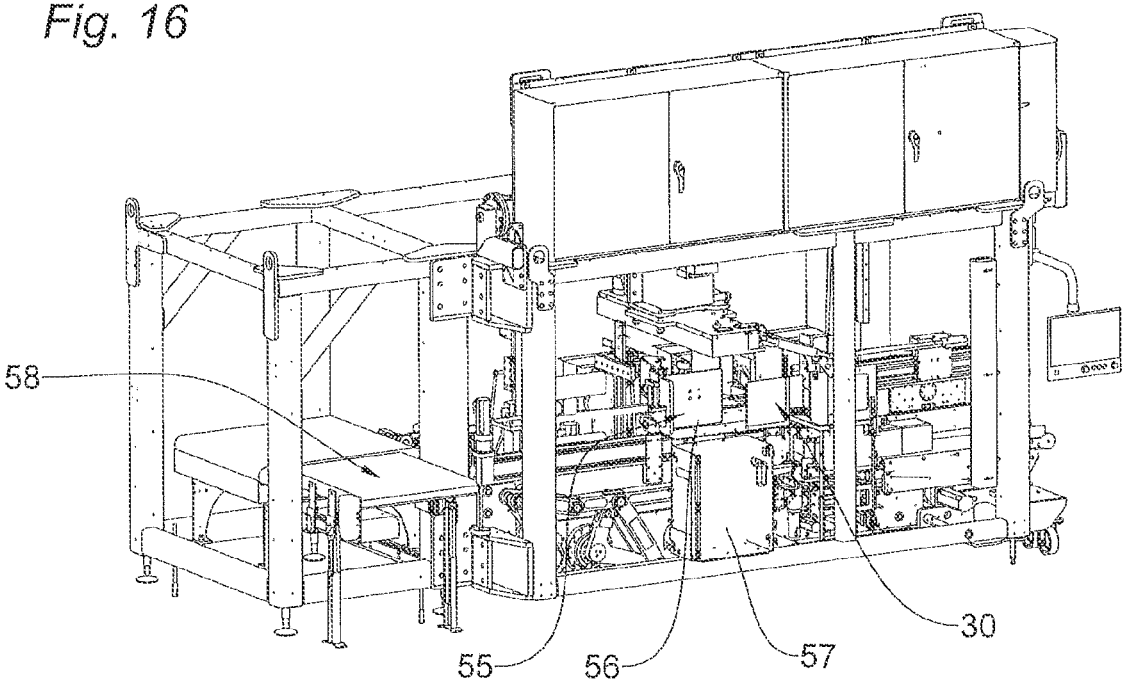
FIG. 16 is a schematic perspective view of the packaging apparatus of FIG. 1.

In this way, the box 2 that has been returned in the folded configuration (FIG. 12) can be brought by the carriage 13 and by the gripping device 12 to the first rejection station 50 (FIG. 13). Here, in order to prevent the abutment element 18 from obstructing the passage of the box 2 towards the first rejection station 50, the carriage 13 is lowered, and the motorised belts 51 collect the box 2 and send it to a discharge container, while the gripping device 12 and the carriage 13, disengaged from the box 2, can restart the packaging cycle (FIG. 14).

Alternatively, prior to rejection, the control unit may command the gripping device 12 and the carriage 13 to try to open again the box 2 and to bring it to a new control of the first sensors 45.

The number of attempts to reopen box 2 is programmable, naturally taking into account production requirements.

During the procedure of folding the box and the subsequent attempt to reopen it or to reject it, the group of products 1 prepared in the composition station 20 remains in position in the insertion station 30 waiting for the correctly opened box 2, which can be the same box of the first attempt or a new box.

At the same time, in the composition station 20, thanks to the joint action of the lifting device 22 and the bundling member 23, the groups of products ready to be inserted in the box 2 in the open configuration are formed.

Once the group of products has been formed on the bundling member 23, the second sensor 25 detects its height and/or any other significant dimension, so that the control unit can verify whether the group of products has been formed correctly.

If the verification is positive, then the group of products 1 is moved by the movement device 24 at the insertion station 30, so that the pushing member 31 can insert it into the open box 2.

If, on the other hand, the verification is negative, then the group of products 1 is moved by the movement device 24 as far as the second rejection station 55, where the pusher element throws the non-conforming group of products into the discharge container 57.

The open box 2, present in the insertion station 30 waiting for the group of products 1 is meanwhile kept in position waiting for the next group of products formed by the composition station 20.

Similarly, if the box 2 is the one that has to be rejected, it is the group of products 1 that will remain in position in the insertion station 30 waiting for a new box 2.

It goes without saying that a person skilled in the art may, in order to meet specific and contingent application requirements, make further modifications and variants of the above-described present invention within the scope of protection as defined by the following claims.

What is claimed is:

1. A method for packaging products in boxes, comprising:

a) providing a plurality of boxes in a folded configuration, b) collecting one of said boxes in the folded configuration from said plurality and modifying the configuration thereof so as to bring it into an open configuration which is suitable for containing said products, c) verifying the conformity of said box in the open configuration with at least one predetermined quality parameter, and d) if said box in the open configuration complies with said at least one quality parameter, introducing said products into said box, while e) if said box in the open configuration does not comply with said at least one quality parameter, returning said box to the folded configuration, wherein the configuration of said box is modified from the folded configuration to the open configuration by an unfolding mechanism and from the open state to the folded state by the same mechanism which is operated in an opposite mode.

2. A method according to claim 1, wherein said box, once it has been returned to the folded configuration, is again brought into the open configuration, and then subjected to said steps c), d) or e).

3. A method according to claim 1, wherein said box, once it has been returned to the folded configuration, is rejected.

4. A method according to claim 1, wherein the configuration of said box is modified from the folded state to the open state by an unfolding mechanism and during said verification of conformity said box is maintained in engagement by said unfolding mechanism.

5. A method according to claim 1, wherein said quality parameter is a correct orientation of at least one lateral panel of said box.

6. A method according to claim 1, wherein said quality parameter is a correct orientation of at least one base panel which extends from a respective lateral panel of said box.

7. A method according to claim 1, wherein said box is brought into the open configuration by maintaining a lower lateral panel on a support plane and moving an upper lateral panel, which is opposite said lower lateral panel, away from said support plane, wherein said upper lateral panel is moved perpendicularly to said support plane, while said lower lateral panel is moved along said support plane.

8. A method according to claim 7, wherein said quality parameter is a correct orientation of at least one base panel which extends from a respective lateral panel of said box, and wherein said at least one base panel extends from said upper lateral panel of said box.

9. A method according to claim 7, wherein a correct orientation of a base panel which extends from said lower lateral panel of said box is controlled.

* * * * *